US006268567B1

(12) United States Patent
Brodsky et al.

(10) Patent No.: US 6,268,567 B1
(45) Date of Patent: Jul. 31, 2001

(54) DUAL PURPOSE RIBBON CABLE

(75) Inventors: William L. Brodsky, Binghamton; David V. Caletka, Apalachin; William infantolino, Vestal, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/491,066

(22) Filed: Jan. 25, 2000

(51) Int. Cl.[7] ..... H01B 7/08
(52) U.S. Cl. ..... 174/117 F; 174/47
(58) Field of Search ..... 174/117 F, 117 FF, 174/44, 117 AS; 439/404, 405, 418, 630

(56) References Cited

U.S. PATENT DOCUMENTS

| | | | | |
|---|---|---|---|---|
| 3,654,380 | * | 4/1972 | Tatum et al. | 174/47 |
| 4,850,899 | * | 7/1989 | Maynard | 438/628 |
| 4,860,351 | | 8/1989 | Weingart . | |
| 5,027,397 | | 6/1991 | Double et al. . | |
| 5,083,238 | * | 1/1992 | Bousman | 174/117 F X |
| 5,159,629 | | 10/1992 | Double et al. . | |
| 5,268,531 | * | 12/1993 | Nguyen et al. | 174/117 F X |
| 5,285,734 | | 2/1994 | MacPherson . | |
| 5,289,785 | | 3/1994 | MacPherson et al. . | |
| 5,384,430 | * | 1/1995 | Anthony et al. | 174/117 F X |
| 5,539,379 | | 7/1996 | MacPherson . | |
| 5,858,500 | | 1/1999 | MacPherson . | |
| 6,005,193 | * | 12/1999 | Markel | 174/117 FF |

* cited by examiner

*Primary Examiner*—Chau N. Nguyen
(74) *Attorney, Agent, or Firm*—McGinn & Gibb, PLLC; Arthur J. Samodovitz, Esq.

(57) ABSTRACT

A ribbon cable includes electrical conductors surrounded by an insulator and vent tubes positioned adjacent and parallel to the conductors and insulator. The vent tubes allow airflow between an internal area of the enclosure and an external atmosphere and prevent access to the internal area of the enclosure.

11 Claims, 2 Drawing Sheets

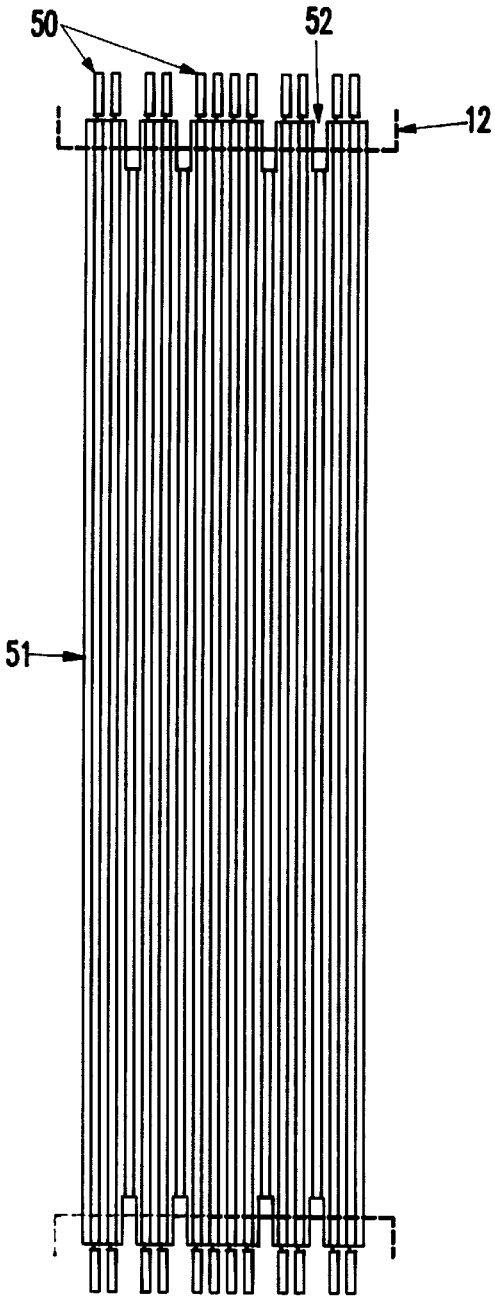
FIG.5
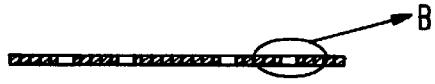
FIG.6A
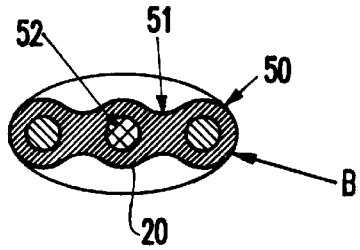
FIG.6B
FIG.7
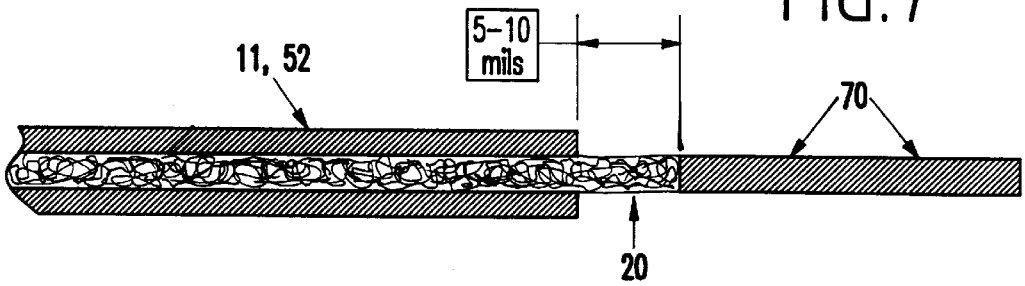

DUAL PURPOSE RIBBON CABLE

BACKGROUND OF THE INVENTION

1. Field of the Invention

The present invention generally relates to ribbon cables and more particularly to a ribbon cable which includes vent tubes that allow for pressure equalization while simultaneously minimizing the risk of unwanted intrusion.

2. Description of the Related Art

Flat ribbon cables are useful in many environments and are especially useful for encapsulated enclosures. For example, a cryptographic processor card (crypto-card) which complies with FIPS (Federal Information Processing Standard) Level 4 (highest possible security) must be capable of detecting any intrusion into the encapsulated enclosure containing protected data, uses ribbon cables.

Such a crypto-card and its enclosure are completely surrounded by a "tamper detection mesh" from which one or more flat ribbon cables protrude through folds in the mesh. The assembly is fully encapsulated, with the exception of protruding cables, in a resin system tailored to the mesh materials. Any attempt subsequent loss (erasure) of vital security data resident on the crypto-card in order to prevent unauthorized access to critical data being stored on or transmitted by the crypto-card.

The encapsulation of the crypto-card enclosure assembly, the tamper detection mesh, and the pressure differentials which can form between the inside of the enclosure and the outside atmosphere result in stresses on the assembly, particularly the tamper detection mesh. The pressure differentials arise from thermal conditions, changes in barometric pressure and altitude changes. Therefore, there is a need for ventilation of the crypto-card enclosure assembly which does not compromise the integrity of the enclosure.

SUMMARY OF THE INVENTION

It is, therefore, an object of the present invention to provide an encapsulated enclosure having a ribbon cable that includes electrical conductors surrounded by an insulator and vent tubes positioned adjacent and parallel to the conductors and insulator. The vent tubes allow airflow between an internal area of the enclosure and an external atmosphere and prevent access to the internal area of the enclosure.

The vent tubes can be connected externally to the ribbon cable or positioned internally within the ribbon cable. There can also be a mesh within the vent tubes which can include fused contacts at the ends of the vent tubes to allow an electrical connection to be made. The ribbon cable can include a card connector for being inserted into a connector housing and the ends of the vent tubes are positioned approximately 5–20 mils from the connector housing. The vent tubes have a diameter of approximately 5–10 mils.

BRIEF DESCRIPTION OF THE DRAWINGS

The foregoing and other objects, aspects and advantages will be better understood from the following detailed description of preferred embodiments of the invention with reference to the drawings, in which:

FIG. 5 is a schematic diagram of a flat ribbon cable according to another embodiment of the invention;

FIGS. 6*a* and 6*b* show schematic diagrams of a cross-sectional view and expanded cross-sectional view B of the flat ribbon cable according to the embodiment of the invention shown in FIG. 5; and FIG. 7 is a schematic diagram of a side view of a vent tube including conductive wire mesh and a fused contact, according to one embodiment of the invention.

DETAILED DESCRIPTION OF PREFERRED EMBODIMENTS OF THE INVENTION

Figure 1:
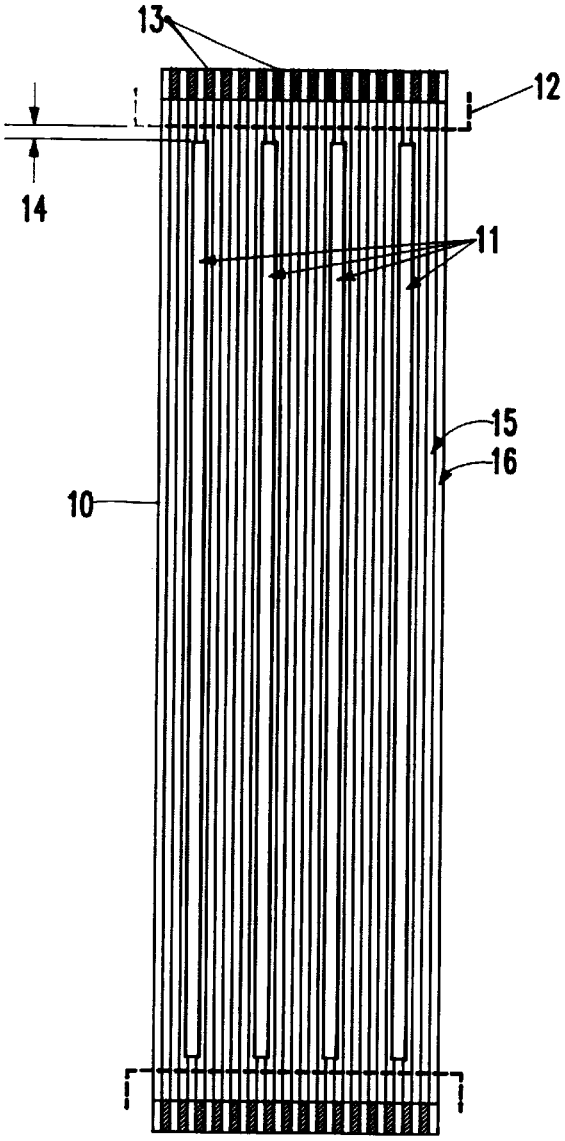
FIG. 1 is a schematic diagram of a top view of a flat ribbon cable according to one embodiment of the invention.

As mentioned above, there is a need for ventilation of enclosure assemblies (such as crypto-card assemblies) which does not compromise the security integrity of the enclosure. The invention, described below, provides vent tubes with the cables extending from the crypto-card enclosure assembly to alleviate the pressure differentials between the interior of the crypto-card enclosure and the exterior atmosphere. With such vent tubes, the invention reduces the number of failure mechanisms within enclosure assemblies, such as the FIPS compliant crypto-card enclosure assembly discussed above.

The invention allows for pressure equalization within the encapsulated crypto-card enclosure while minimizing the risk of probe intrusion. As shown in FIGS. 1–4, one embodiment of the invention comprises a flat ribbon cable 10 which has been modified to include very small vent tubes 11. The ribbon cable 10 includes conductors 15, separated by insulators 16, both running along the length of the ribbon cable 10. The vent tubes 11 also run along the length of the ribbon cable parallel to the conductors/insulators 15, 16.

The vent tubes 11 can be made from any flexible material, such as a polymer, etc., and are either added the flat ribbon cable 10 after it is manufactured, or formed as part of the flat cable as the flat cable is formed. The material choice for the vent tubes 11 must be sufficiently strong to not collapse under the pressure exerted by the enclosure surrounding the crypto-card, yet flexible enough to bend and move as the flat ribbon cable 10 moves.

In the embodiment shown in FIG. 2, the vent tubes 11 are positioned over the flat ribbon cable 10. The vent tubes 11 have an inner diameter which is large enough to allow a minimum volume of air to pass, yet small enough that a physical, electrical or optical probe cannot be easily manipulated through the vent tubes 11, rendering intrusion essentially impossible. In a preferred embodiment, the vent tubes 11 have an inner diameter which is less than 5–10 mils. The air flow rate required is based on the rate of thermal excursions and external pressure changes and, as would be known by one ordinarily skilled in the art given this disclosure, the diameter and the number of vent tubes 11 can be adjusted to provide sufficient airflow.

Figure 2A:
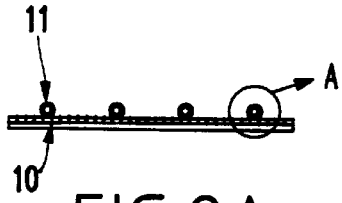
FIGS. 2*a* and 2*b* are schematic diagrams of a cross-sectional view and expanded cross-sectional view A of a flat ribbon cable according to one embodiment of the invention.
Figure 2B:
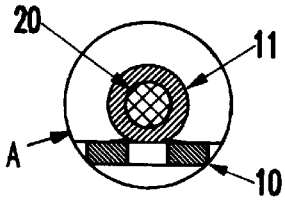

As also show in FIGS. 2*a* and 2*b*, the invention may optionally include a mesh 20 within the vent tube 11. The mesh 20 acts a physical barrier to prevent probe items from being inserted into the vent tubes 11. The mesh 20 may be a woven mesh or porous member comprised of metal, plastic or ceramic. The mesh 20 can be made of any suitable material, such as metal wire or the same material as the vent tube itself, so long as the mesh 20 has sufficient strength to prevent probe insertion into the vent tubes 11. Further, the mesh 20 can be placed at any position within the vent tubes 11, such as at the ends of the vent tubes 11, the center of the vent tubes, etc. or the mesh 20 can run the entire length of the vent tubes 11, be made of any suitable material, such as metal wire or the same material as the vent tube itself, so long as the mesh 20 has sufficient strength to prevent probe insertion into the vent tubes 11. Further, the mesh 20 can be placed at any position within the vent tubes 11, such as at the ends of the vent tubes 11, the center of the vent tubes, etc. or the mesh 20 can run the entire length of the vent tubes 11.

Figure 3:
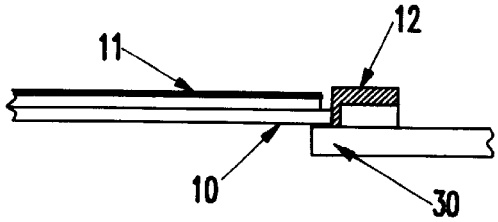
FIG. 3 is a schematic diagram of a side view of a flat ribbon cable and connector according to one embodiment of the invention.
Figure 4:
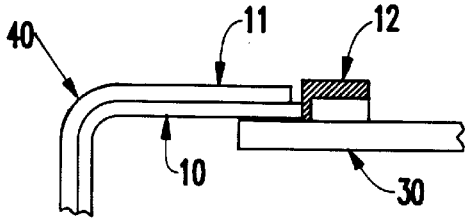
FIG. 4 is a schematic diagram of a side view of a flat ribbon cable and connector according to one embodiment of the invention.

In addition, as shown in FIGS. 3 and 4, the ends of the vent tubes 11 are placed in close proximity to the edge of the connector housing 12 which will receive the contacts 13 of the cable 10. In FIGS. 3 and 4, the connector 12 is shown supported by a card 30, such that after the contacts 13 are inserted into the connector 12, only a small gap 14 (FIG. 1) remains between the connector 12 and the ends of the vent tubes 11. This narrow gap 14 is in the range of 5–20 mils, in a preferred embodiment. The narrow gap 14 insures that an obstruction exists in close proximity to the vent tube 11 ends so as to make full insertion of a probe, or electrical or optical device essentially impossible.

Further, as shown in FIG. 4, the flat ribbon cable 10 typically includes at least one 90° bend 40 near the card connector 12. Typically several 90° and near 180° bends would be present along the entire length of the ribbon cable. Again, the proximity of the vent tube 11 end to the connector 12 housing, the small diameter of the vent tube 11, the mesh 20 and the 90° bend 40, all contribute to the hampering of electrical, mechanical and optical probe intrusion into the enclosure, while allowing for at least a minimal level of air flow.

FIGS. 5, 6*a* and 6*b* depict a round conductor ribbon cable embodiment of the current invention. More specifically, FIGS. 5, 6*a* and 6*b* illustrate a cable 51 of round ribbons which have conductors 50 that connect with the connector 12 (as discussed in the previous embodiment). An important feature of the second embodiment is that the vent tubes 52 do not have a conductor 50. FIGS. 6*a* and 6*b* again illustrates the mesh 20 within the vent tubes 52, as discussed above. As with the previous embodiments, the vent tubes 52 allow air flow to the interior of the encapsulated enclosure. In addition, the ends of the vent tubes 52 are positioned in close proximity to the end of the connector 12 to make it essentially impossible to insert a physical, electrical or optical intrusion device, yet allow sufficient air flow.

FIG. 7 illustrates another embodiment of the invention and is a schematic diagram of a side view of a vent tube that includes conductive wire mesh 20 and a fused contact 70. As shown in FIG. 7, the conductive metallic mesh 20 can be fused 70 (e.g., soldered or brazed) 5–10 mils beyond the point where it exits the vent tube 11, 52. The fused portion 70 of the metallic mesh 20 is a contact for being inserted into a connector on the card. Thus, the metallic mesh 20 can be simultaneously used as an electrical conductor and a vent tube. Therefore, with this embodiment of the invention, some or all the vent tubes 11, 52 could be additional conductor lines. Alternatively, in the embodiment shown in FIGS. 5 and 6, all conductors 50 could be replaced with the inventive vent tube conductor shown in FIG. 7.

Thus, as shown above, the vent tubes 11, 52 (e.g., on or within an otherwise conventional electrical cable) allow for airflow between the encapsulated enclosure of a crypto-card enclosure assembly and the external atmosphere. The small inner diameter of the vent tubes 11, 52 coupled with the mesh 20, the proximity of the tube ends to the card connector 12, and multiple 90° and near 180° bends minimize the risk of enclosure intrusion with various probes (mechanical, electrical, optical, etc.).

As discussed above, the invention incorporates the vent tubes with the communication/power supply cable. This substantially simplifies the manufacturing process for the card enclosures because no separately manufactured vent tubes are needed at other locations of the assembly. Further, the restrictions discussed above with respect to the diameter of the vent tubes 11, 52, the mesh 20, and the vent tube's 11, 52 proximity to the connector 12 housing provides superior security than conventional vent holes. In addition, the vent tubes 11, 52 are disguised by the cable and may not be recognized as a point of entry for a potential intruder.

While the invention has been described with a specific crypto-card encapsulated enclosure, as would be known by one ordinarily skilled in the art given this disclosure, the invention is equally applicable to any encapsulated enclosure where pressure equalization or other venting would be beneficial. The invention is discussed above with respect to a specific device because of the intrusion resistant benefits the invention provides. However, because of the cost savings, space savings, and reduced manufacturing steps the invention is applicable to all types of encapsulated enclosures, whether security is important or not. The invention is especially applicable to automotive and aerospace applications where large fluctuations in temperature, barometric pressure and altitude are possible.

While the invention has been described in terms of preferred embodiments, those skilled in the art will recognize that the invention can be practiced with modification within the spirit and scope of the appended claims.

What is claimed is:

1. A ribbon cable comprising:

electrical conductors surrounded by an insulator; and at least one vent tube positioned adjacent and parallel to said conductors and insulator; and at least one card connector configured for being inserted into at least one connector housing, wherein at least one end of said vent tube is configured for being positioned adjacent said connector housing, and wherein said end of said vent tube is approximately 5–20 mils from said connector housing.

2. An encapsulated card enclosure assembly including an enclosure surrounding a card, and at least one ribbon cable connected to said card and extending outside said enclosure, said ribbon cable comprising:

electrical conductors surrounded by an insulator; and at least one vent tube positioned adjacent and parallel to said conductors and insulator, wherein said card includes a connector housing and said ribbon cable further comprises a card connector that configurably can insert into said connector housing on said card, and wherein at least one end of said vent tube is positioned adjacent to said connector housing.

3. The encapsulated card enclosure assembly in claim 2, wherein said end of said vent tube is approximately 5–20 mils from said connector housing.

4. An encapsulated crypto-card enclosure assembly including an enclosure surrounding a card, and at least one ribbon cable connected to said card and extending outside said enclosure, said ribbon cable comprising:

electrical conductors surrounded by an insulator; and at least one vent tube positioned adjacent and parallel to said conductors and insulator, said vent tube allowing airflow between an internal area of said enclosure and an external atmosphere and said vent tube preventing access to said internal area of said enclosure.

5. The encapsulated crypto-card enclosure assembly in claim 4, wherein said vent tube is connected externally to said ribbon cable.

6. The encapsulated crypto-card enclosure assembly claim 4, wherein said vent tube is internal to said ribbon cable.

7. The encapsulated crypto-card enclosure assembly in claim 4, further comprising mesh within said vent tube.

8. The encapsulated crypto-card enclosure assembly in claim 7, wherein said mesh includes a fused contact.

9. The encapsulated crypto-card enclosure assembly in claim 8, wherein said fused contact and said mesh comprise a conductor running a full length of said vent tube.

10. The encapsulated crypto-card card enclosure assembly in claim 4, wherein said card includes a connector housing and said ribbon cable further comprises a card connector for being inserted into said connector housing on said card, and wherein at least one end of said vent tube is positioned approximately 5–20 mils from said connector housing.

11. The encapsulated crypto-card enclosure assembly in claim 4, wherein said vent tube has a diameter of approximately 5–10 mils.

* * * * *